US005585699A

United States Patent [19]

Schulz

[11] Patent Number: 5,585,699

[45] Date of Patent: Dec. 17, 1996

[54] CONTROL CIRCUIT FOR FLUORESCENT LAMPS

[75] Inventor: Reinhard Schulz, Immenstaad, Germany

[73] Assignee: HILITE Lighting and Electronics Ltd., Mosta, Malta

[21] Appl. No.: 401,037

[22] Filed: Mar. 7, 1995

[30] Foreign Application Priority Data

Nov. 18, 1994 [DE] Germany ..... 44 41 140.5

[51] Int. Cl.[6] ..... G05F 1/00

[52] U.S. Cl. ..... 315/293; 315/291; 315/307; 315/362; 315/DIG. 4

[58] Field of Search ..... 315/291, 293, 315/297, 86, 200 R, 307, 362, DIG. 4, DIG. 5, DIG. 7

[56] References Cited

U.S. PATENT DOCUMENTS

| | | | |
|---|---|---|---|
| 4,604,552 | 8/1986 | Alley et al. | 315/DIG. 4 X |
| 4,663,569 | 5/1987 | Alley et al. | 315/DIG. 4 X |
| 4,733,138 | 3/1988 | Pearlman et al. | 315/307 |
| 5,177,409 | 1/1993 | Nilssen | 315/293 |
| 5,194,781 | 3/1993 | Konopka | 315/291 |

FOREIGN PATENT DOCUMENTS

| | | |
|---|---|---|
| 1924012 | 11/1970 | Germany . |
| 3211240 | 3/1982 | Germany . |
| 3943350 | 12/1989 | Germany . |
| 4037948 | 11/1990 | Germany . |
| 4236145 | 10/1992 | Germany . |
| 4328306 | 8/1993 | Germany . |

*Primary Examiner*—Robert Pascal
*Assistant Examiner*—Haissa Philogene
*Attorney, Agent, or Firm*—Baker, Maxham, Jester & Meador

[57] ABSTRACT

A dimmer logic for fluorescent lamps is described which operates after the principal of a two-point circuit with two stable operating points, where in dimmer operation periodic changes between the two operating points takes place. By periodically switching on and off the fluorescent lamp the average brightness of the fluorescent lamp is reduced. The dimmer logic can be extended by sensor inputs for current and voltage to control the voltage, current and power. By appropriate design of the dimmer logic a control and protection circuit for overcurrent, overvoltage and overpower can be realized.

8 Claims, 4 Drawing Sheets

Normal Operation

Dimmer Operation

CONTROL CIRCUIT FOR FLUORESCENT LAMPS

FIELD OF INVENTION

The invention relates to a dimmer circuit for fluorescent lamps.

BACKGROUND OF INVENTION

In known dimming circuits for fluorescent lamps the lamp is continuously operated and to set a specific dimming level the supply current of the lamp has to be varied. A drawback of known dimmer circuits is that high design effort is necessary to achieve a stable operating point at any dimming level.

SUMMARY OF INVENTION

The object of the present invention is to improve a dimmer circuit according to the state of the art in such a way that with minimal design effort a stable operating point of the circuit is achieved.

The heart of the invention is a dimmer circuit which operates in two-point operation, i.e., as a two-point controller, which works alternatively in two stable operating points, which corresponds to two different brightness levels of the fluorescent lamp connected to the circuit. The circuit cooperates with an electronic ballast unit necessary to operate the fluorescent lamp. Because only two stable operating points are necessary the circuit works in a simple and stable way. Known dimmer circuits are continuously dimmed by means of analog control loops with the disadvantage of having stability problems. For dimming a lamp connected to the circuit described here the frequency of the converter is changed, e.g., from 40 kHz to 80 kHz. This is done by disconnecting a capacitor by means of a controlling integrated circuit which capacitor determines the frequency of the oscillator of the ballast unit. The capacitor is connected and disconnected to the oscillator by a switch which is controlled by a controller IC. The frequency of the converter is therefore increased or decreased from 40 kHz to 80 kHz and the other way round.

With that the brightness (full brightness and half brightness) of the fluorescent lamp connected thereto is controlled.

Caused by the frequency rise of the converter the inductive resistance of an inductor (choke) connected in series with the fluorescent lamp increases, thus the current through the fluorescent lamp decreases accordingly. With the reduced current the fluorescent lamp will light less bright. As the supply voltage of the converter falls under a defined level, the lamp current gets so small that the gaseous discharge stops. Due to the periodically varying supply voltage the fluorescent lamp alternatively turns off and on. This pulsed operation reduces the average brightness of the lamp.

Advantageously no additional design effort is needed to stabilize the dimmer operation.

Therewith the power consumption of the lamp is reduced more than 50% without specific steps of stabilization during dimmer operation (no control loop and the like to keep the lamp current constant).

The principal of the present invention lies in controlling the frequency of the converter by means of suitable circuitry. The embodiment already discussed describes the connection and disconnection of a capacitor which determines the oscillating frequency of the converter.

In another embodiment of the present invention it is intended to vary other elements of the converter periodically, e.g., to vary the inductance of the oscillating circuit or the inductance and the capacitance. It is also possible to reduce the current of the converter or periodically switching on and off of the supply voltage of the converter or switching on and off the load periodically.

In still another embodiment it is intended to periodically connect and disconnect components in parallel or in series with the fluorescent lamp.

BRIEF DESCRIPTION OF THE DRAWINGS

The invention will now be further described by way of example with reference to the accompanying drawings, wherein.

DETAILED DESCRIPTION OF THE PREFERRED EMBODIMENT

The circuit described is adapted to a mains voltage of 230 Volts. However it may also be easily adapted to a mains voltage of 110 Volts.

Figure 1:
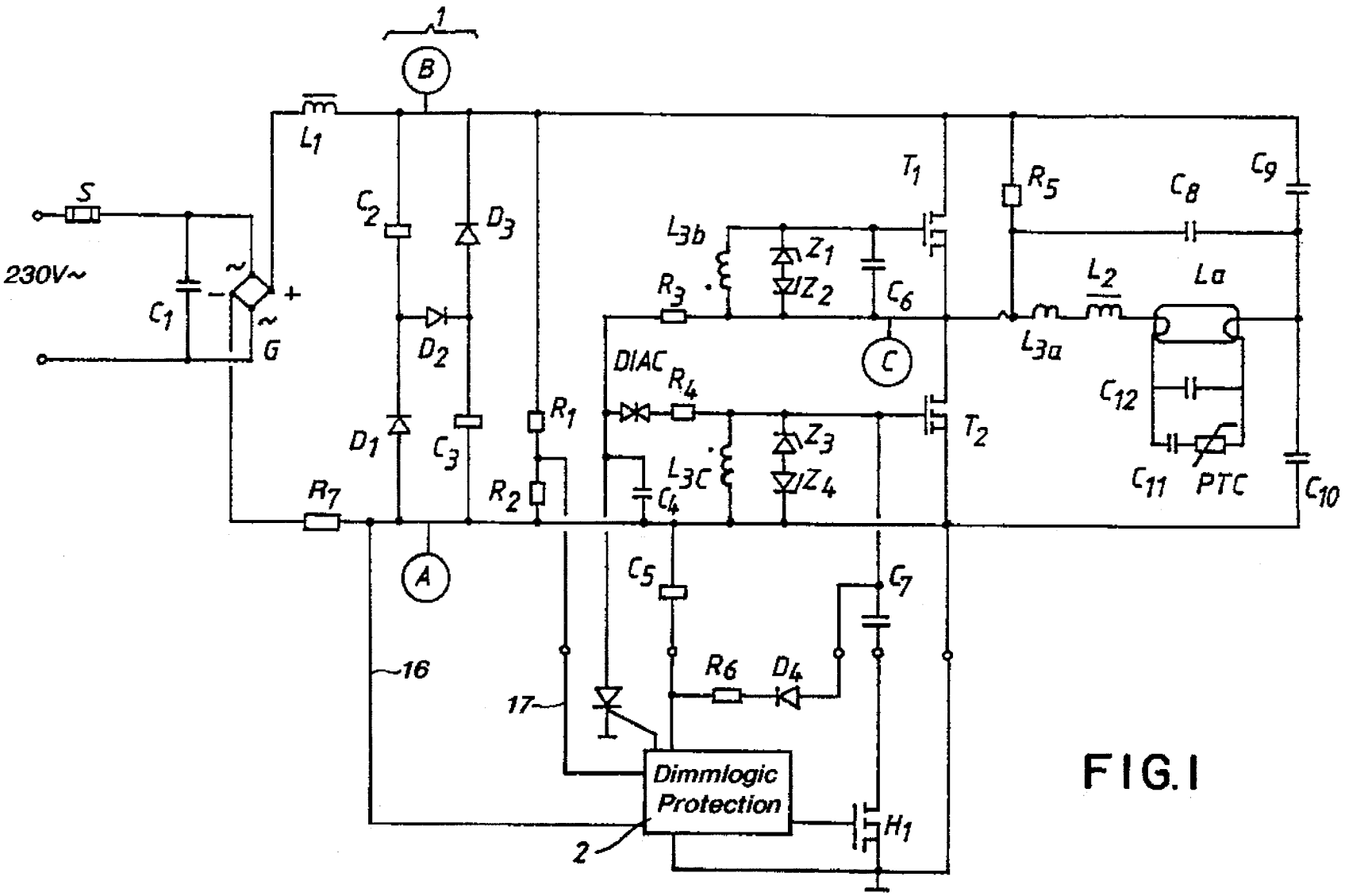
FIG. 1: schematically shows the circuit diagram of a converter with dimmer circuit.

FIG. 1 shows the converter circuit and the basic circuit diagram of the dimmer. The mains voltage is rectified by means of rectifier G to give a pulsating DC voltage on nodes A and B of the circuit. As long as the instantaneous value of the mains voltage is higher than half of its peak value the converter circuit is supplied directly from the mains. In this case the converter acts like a constant current sink. As the mains voltage reaches its peak value, the capacitors C2 and C3 are charged in series through the diode D2. Because the series capacity of the capacitors C2 and C3 is only about 0.5 microfarad the charging current peak of capacitors C2 and C3 is relatively small. During the period in which the mains voltage is smaller than half of its peak value the converter circuit is supplied from the capacitors C2 and C3 now connected in parallel through the diodes D1 and D3. During this time the current taken from the mains is zero. The function of capacitors C2 and C3 is to supply the converter and the load during the zero crossing of the mains voltage. With said supply method a good power factor of about 0.9 is achieved.

The converter circuit is preferably a half-bridge converter generating a AC voltage of high frequency needed to supply the gas discharge tube. As the mains is powered up the capacitor C4 is charged through the resistors R5 and R3 until the voltage reaches the breakthrough voltage of the diac (about 245 Volts). The diac fires and gives a start pulse on the gate of transistor T2 while the converter starts oscillating. At test point C a high frequency square wave AC voltage can be measured. The average voltage on test-point C, across capacitor C4, is lower than the breakthrough voltage of the diac thus further firing of the diac is prevented.

Transformer L3 controls the power transistors T1 and T2. The oscillating frequency of the converter is basically determined by the components L3, C6 and C7 and also by the gate capacities of the power transistors T1 and T2. The zener diodes Z1 to Z4 protect the power transistors from overvoltage.

The inductor L2 controls the current through the lamp LA.

The resistance of a PTC resistor connected in parallel to the Lamp LA is low after powering up the circuit. At the first moment the voltage on the lamp is therefore low. The hot-cathodes of the lamp are preheated. The current flow through the PTC gets it warmer and its resistance increases. The inductor L2 and the capacitor C12 getting in resonance, the voltage across the lamp increases until the gaseous discharge starts at about 500 Volts. The resonance of L2 and C12 is damped by the conducting gas discharge tube. The voltage across the cathodes stabilizes at the sustain voltage of the lamp. The heater current strongly decreases.

Due to the input rectification the supply current of the converter is pulsating at 100 Hz, the lamp current is also pulsating as well as the lamp's brightness. This pulsation is normally not visible. In the lower part of the circuit diagram of the converter the dimmer circuit is shown. During dimmer operation the frequency of the converter is increased from about 40 kHz to about 80 kHz. This is obtained by disconnection of capacitor C7 by means of a transistor switch H1 which is controlled by the dimmer logic 2. Due to the frequency increase the inductive resistance of inductor L2 increases, whereas the capacitive resistance of capacitor C12 decreases. This results in a current reduction in the gas discharge tube, whereas the gaseous discharge stops if the supply voltage of the converter falls below a predetermined level reducing the lamp current. Due to the periodic variation of the supply voltage the lamp permanently turns off and on again. This pulse operation reduces the average brightness of the lamp which gives the dimming effect.

With this method 50% less current consumption is achieved without particular steps for stabilization of the dimmer circuit during dimmer operation (such as a control loop to keep the lamp current constant).

It was found that during dimmer operation a flickering of the lamp may occur. This was caused by the PTC resistor which changes its resistance, especially in a draughty environment. By simply providing the PTC with a heat insulation the problem was solved.

Figure 2:
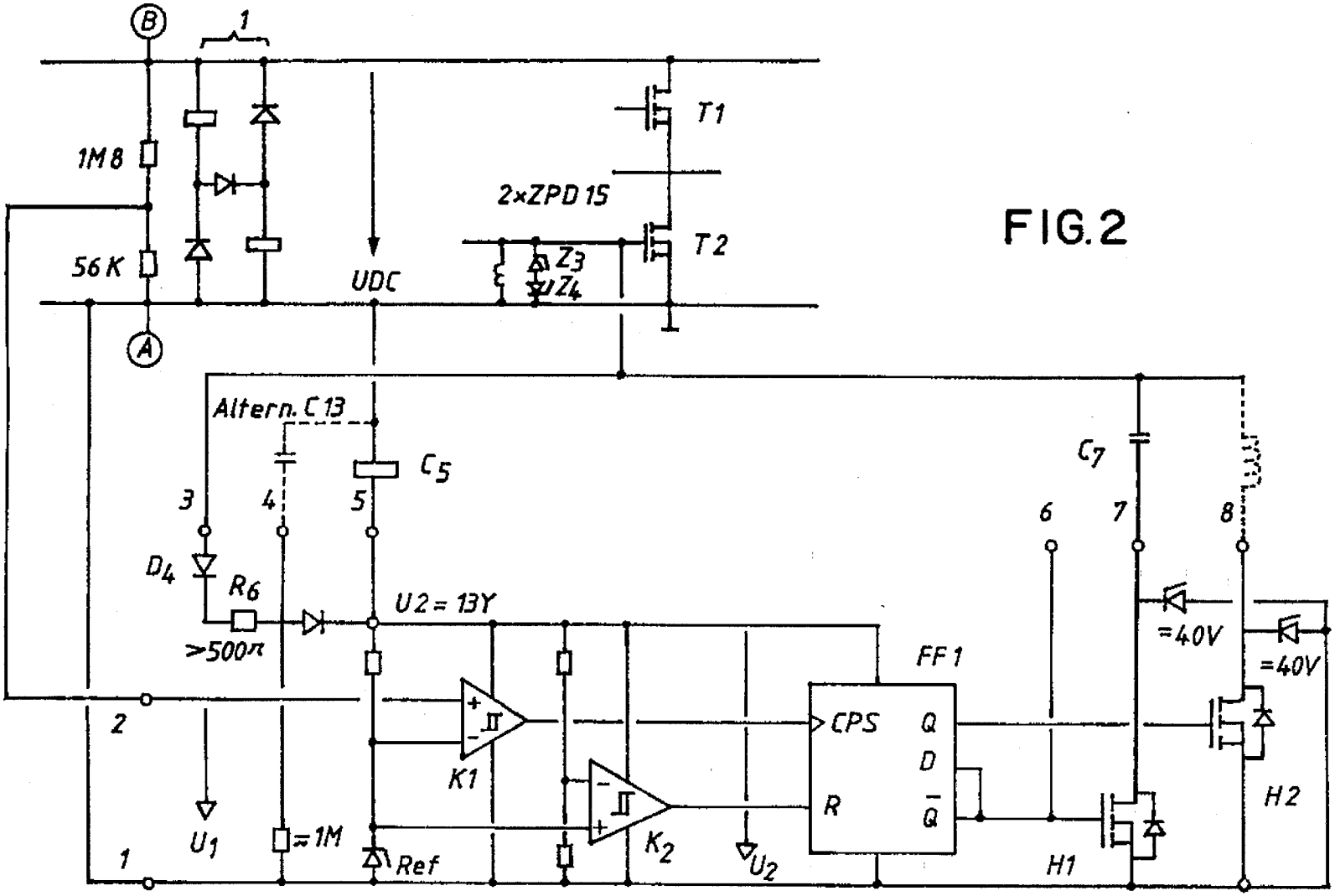
FIG. 2: schematically shows the dimmer circuit.

FIG. 2 gives a detailed example of what the dimmer circuit may look like. By means of the zener diodes Z3 and Z4 the gate control voltage of the transistor T2 is limited to about 16 Volts. A DC current of about 1 milliampere which is rectified through diode D4 is taken from latter control voltage, without disturbing the function of the converter. To supply the dimmer logic a quite constant voltage of about 13 volts smoothed by capacitor C5 is generated. To limit the current drain from the gate control during powering up of the circuit, a resistor R6 of at least 500 Ohms is connected in series with the diode D4.

When the circuit is powered on for the first time after a long interruption period the capacitor C5 is discharged. As long as the voltage across the capacitor C5 is less than 5 volts the output of the comparator K2 is High setting the flip-flop reset input R to High, therefore the output $\overline{Q}$ of the flip-flop stays High. Transistor switch H1 is conducting connecting capacitor C7 to ground. When the circuit is first powered up after a longer break the lamp works in normal operation, i.e., with the connection of capacitor C7 the converter will oscillate at a frequency of about 40 kHz.

If the mains supply is interrupted for a short moment (for about 0.2 to 5 seconds) the voltage across the nodes A and B breaks down. The capacitor C5 however still supplies the dimmer logic, at least for 5 seconds. The mains interruption is detected by the comparator K1 and the output of comparator K1 becomes Low and also does the clock input CPS of the flip-flop FF1 connected to the comparator K1. When the mains supply is switched on again the output of comparator K1 switches to High and the rising edge triggers the CPS input of the flip-flop FF1. The output $\overline{Q}$ of the flip-flop FF1 becomes Low, transistor switch H1 is disabled, capacitor C7 is disconnected and the converter is switched in its dimmer operation.

Instead of monitoring the voltage across the nodes A and B the detection of a mains supply interruption can be made also by detection of the rectified control voltage at transistor T2. In this case the rectified voltage has to be decoupled from the supply of the dimmer logic by means of an additional diode. Because the converter oscillation needs some time to die out after the mains is switched off, the mains interruption has to last at least 0.3 seconds to be detectable. However the detection of a mains interruption between nodes A and B makes even shorter detection times possible. For general purpose use of the converter flip-flop FF1 is provided with a complementary output Q, e.g., for controlling another transistor switch H2.

The whole dimmer logic described here consists generally of the comparators K1 and K2, the flip-flop FF1 and the transistors H1 and H2 and is preferably part of a single custom-made integrated circuit.

Furthermore the dimmer- and security circuit 2 is preferably provided with sensing inputs 16, 17 for current and voltage so that current, voltage and power can be controlled and a suitable overcurrent-, overvoltage- and overpower protection can be realized.

Figure 3:
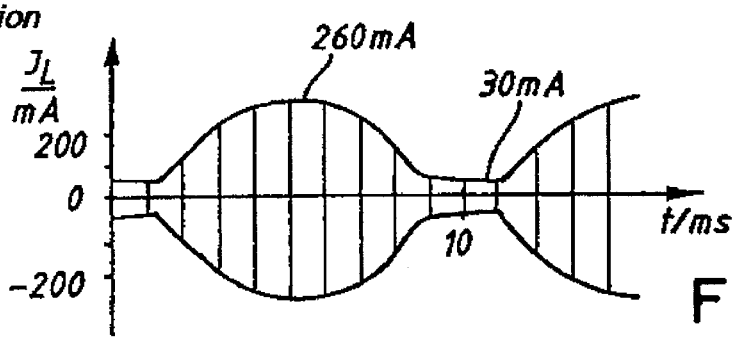
FIG. 3: showing the current diagram of the lamp under normal operation.
Figure 4:
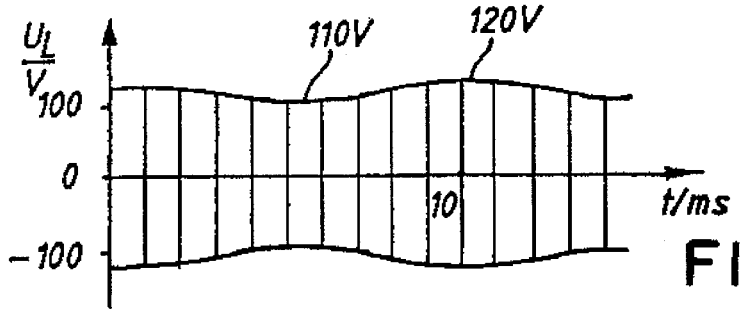
FIG. 4: showing the voltage diagram of the lamp under normal operation.

FIGS. 3 to 6 show the current and voltage waveforms at the gas discharge tube during normal and dimmed operation. During normal operation the sustain voltage of the lamp is relatively constant between 110 to 120 volts as can be seen in FIG. 4. Caused by the pulsation of the supply current at 100 Hz the lamp current also varies periodically in a 100 Hz rhythm between about 260 milliamps max. and 30 milliamps min., as can be seen in FIG. 3. This pulsation is not visible by the human eye and is therefore not disturbing.

Figure 6:
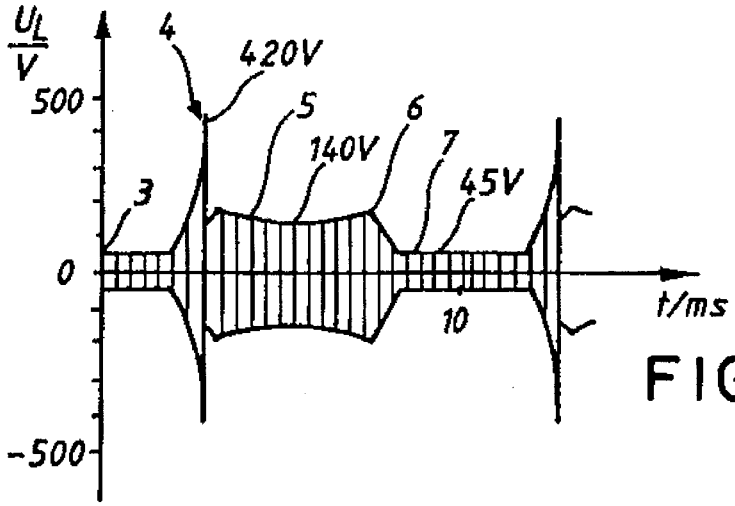
FIG. 6: showing the voltage diagram of the lamp under dimmer operation.

FIG. 6 shows the voltage curve at the lamp during dimmed operation. The switch-over into dimmed operation occurs by a short interruption of the mains supply, see position 3 in FIG. 6. Because the PTC resistor is still warm and has a high resistance the voltage across the gas discharge tube rises quickly so that the gas discharge tube fires at about 420 volts, see position 4. The gas discharge tube works now, see branch 5, with its sustain voltage, here about 140 volts. The region between positions 4 and 6 corresponds to the time wherein the pulsating supply voltage is higher than about 200 Volts. If the supply voltage falls under a specific value, see position 6, the lamp current becomes so small that the gaseous discharge stops caused by a voltage breakdown at the gas discharge lamp to a low level (see position 7). Due to the periodically pulsating supply voltage the lamp continuously switches on and off.

Figure 5:
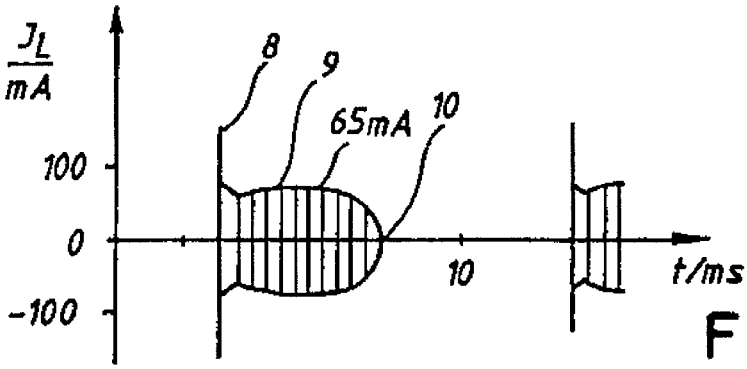
FIG. 5: showing the current diagram of the lamp under dimmer operation.

FIG. 5 shows the current flow through the lamp. At position 8 the lamp fires and the current consumption stays constant in position 9. At position 10 the lamp flames out, the current decreases to zero.

Figure 7:
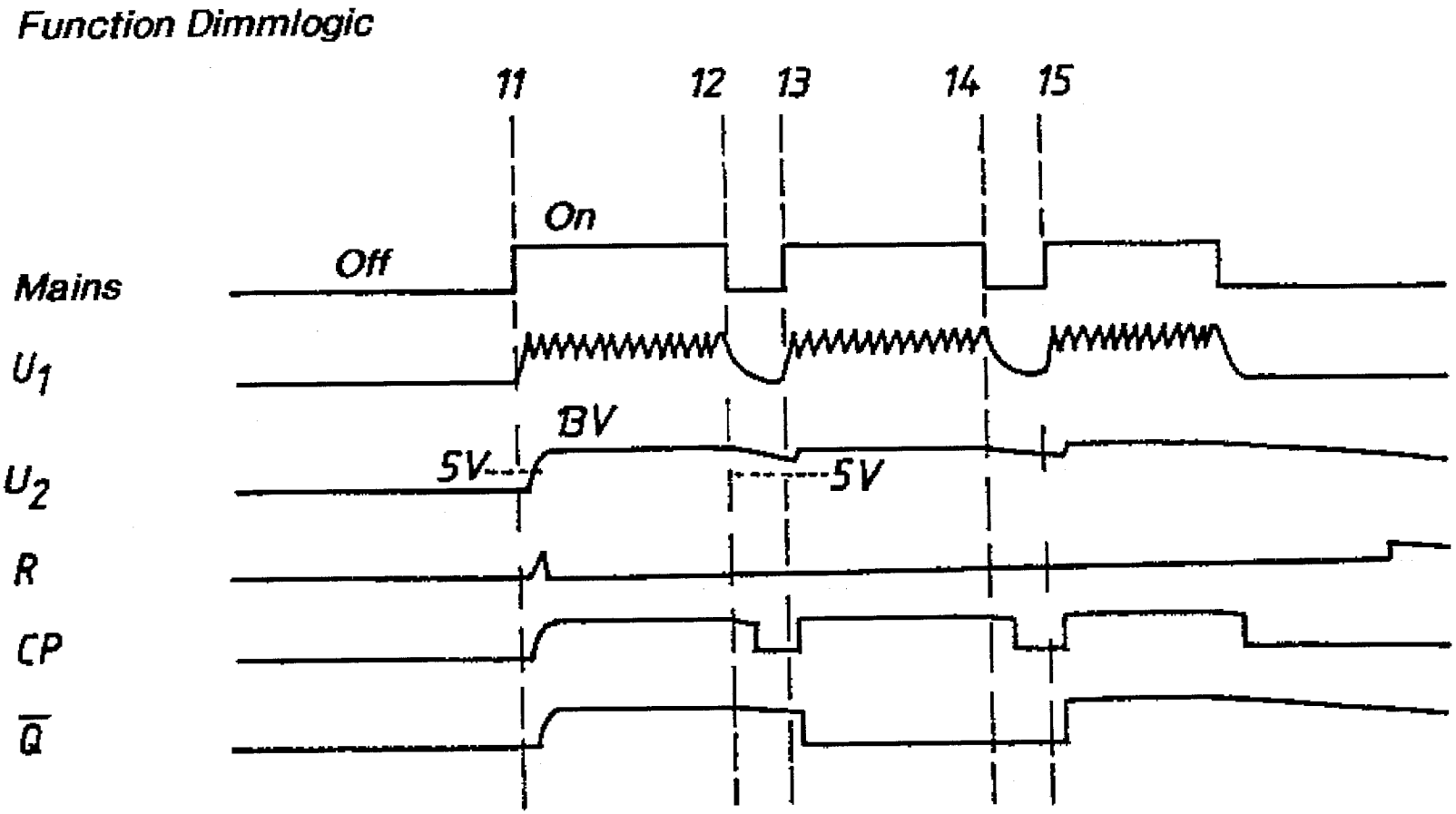
FIG. 7: Voltage diagrams around the IC according to FIG. 2.

FIG. 7 shows different signal levels at the inputs and outputs of the above described control IC. The mains supply is switched on at position 11. U1 is derived from the supply voltage at nodes A and B by means of a voltage divider. The supply voltage U2 for the dimmer logic is derived by rectifying the gate control signal of transistor T2. By a positive pulse at the reset input R the output $\overline{Q}$ of the flip-flop FF1 goes High (40 kHz operation). By a short interrupt of the mains supply, see positions 12, 13, the flip-flop is clocked at its input CPS, while it receives no reset pulse at input R because the dimmer logic is still power supplied. Therefore the output $\overline{Q}$ of the flip-flop changes to Low, i.e., to dimmer operation (80 kHz operation). Another short interrupt between positions 14,15 again changes the state the other way round.

I claim:

1. A control circuit for a fluorescent lamp, the control circuit being selectively connectable to a source of AC electrical power;

rectifier means for converting the AC voltage to pulsating DC electrical power;

converter circuit means for converting the pulsating DC voltage to an AC voltage at a first frequency, said converter circuit supplying the AC voltage to the fluorescent lamp; and a dimmer circuit comprising means to selectively alter the frequency of the AC voltage applied to the fluorescent lamp to a second AC frequency for dimmed operation so that the current through the fluorescent lamp is reduced and the fluorescent lamp periodically extinguishes and re-starts at the pulsating DC frequency, the average light level of the fluorescent lamp in dimmed operation being less than when operating at the first AC frequency.

2. The control circuit recited in claim 1, wherein the extinguished and re-started operating conditions of the fluorescent lamp are both stable operating points.

3. A control circuit for a fluorescent lamp, the control circuit being selectively connectable to a source of AC electrical power;

rectifier means for converting the AC voltage to pulsating DC electrical power;

converter circuit means for converting the pulsating DC voltage to an AC voltage, said converter circuit supplying the AC voltage through an inductor to the fluorescent lamp; and dimmer circuit means comprising:

a capacitor; and means for selectively connecting said capacitor into said converter circuit;

whereby when said capacitor is connected in said converter circuit the AC voltage applied to said inductor is at a first frequency and the fluorescent lamp operates at a first level of brightness, and when said capacitor is disconnected from said converter circuit said AC voltage is applied to said inductor at a second, higher frequency, thereby increasing the effective resistance of said inductor and causing the average brightness of said fluorescent lamp to be substantially reduced in a second level of brightness.

4. The control circuit recited in claim 3, wherein said first frequency is about 40 kHz and said fluorescent lamp is at full brightness, said second frequency is about 80 kHz and the average brightness level of said fluorescent lamp is substantially reduced.

5. The control circuit recited in claim 3, wherein at the higher, second frequency said fluorescent lamp continuously switches on and off between two stable operating points, providing an average light level dimmer than when operating at the first frequency.

6. The control circuit recited in claim 3, wherein said dimmer circuit comprises logic functions responsive to interrupts of the electrical power source to switch said capacitor into and out of said converter circuit.

7. The control circuit recited in claim 6, wherein said logic functions of said dimmer circuit cause said connecter circuit to operate at the first frequency when the electrical power is applied after an interrupt of at least five seconds.

8. A method for controlling the light output level of a fluorescent lamp, said method comprising the steps of:

applying electrical power to the fluorescent lamp through an inductor in a control circuit at a first frequency;

changing the frequency of the electrical power applied to the inductor to a second frequency by changing a capacitance value in the control circuit, thereby increasing the effective resistance of the inductor and reducing the voltage applied to the fluorescent lamp and causing it to dim.

* * * * *